US005358255A

United States Patent [19]

Jolson

[11] Patent Number: 5,358,255

[45] Date of Patent: Oct. 25, 1994

[54] DISC CATCHING APPARATUS

[76] Inventor: Alfred S. Jolson, 1850 Greenwich Ave., Winter Park, Fla. 32789

[21] Appl. No.: 173,204

[22] Filed: Dec. 27, 1993

[51] Int. Cl.[5] ..... A63B 67/06

[52] U.S. Cl. ..... 273/400

[58] Field of Search ..... 273/400, 176 A, 326, 273/34 R, 401

[56] References Cited

U.S. PATENT DOCUMENTS

| | | | |
|---|---|---|---|
| 2,701,140 | 2/1955 | Fortino | 273/176 A |
| 3,905,088 | 9/1975 | Tucker et al. | 273/326 X |
| 4,039,189 | 8/1977 | Headrick et al. | 273/400 |
| 4,461,484 | 7/1984 | Headrick | 273/400 |
| 4,792,143 | 12/1988 | Hendrick | 273/400 |

*Primary Examiner*—William H. Grieb
*Attorney, Agent, or Firm*—William M. Hobby, III

[57] ABSTRACT

A disc catching apparatus for use in playing a flying disc game includes a vertically extending post supported in the earth or in a portable stanchion and having a basket attached thereto around the post between its ends. A top housing is attached to the top of the post and spaced from the basket and a plurality of elongated flexible disc stopping members, such as flexible chains, are attached to the top housing and hang downwardly into the basket for stopping the flying objects impinging thereupon so that the flying objects will fall into the basket. The top housing has an interior compartment therein having at least one lamp for lighting the basket and hanging chain as well as lighting a translucent lens so that a flying disc game can be played in low light. An improved attachment is provided for attaching chains to the top housing and an improved basket mounting coupler is provided for supporting the basket which coupler can be readily injection molded.

14 Claims, 2 Drawing Sheets

DISC CATCHING APPARATUS

BACKGROUND OF THE INVENTION

The present invention relates to a disc catching apparatus for use in playing a flying disc game.

Flying disc golf games have recently been placed on courses laid out in parks or other recreational areas. A flying disc golf course comprises a number of holes, each comprising a tee from which a flying disc is originally thrown by each player. The holes include a post placed at a selected distance from the tee and adapted to capture the flying disc if the disc is thrown so as to impinge upon the hole to allow the disc to fall into a basket attached to the post. In playing the golf game, the flying disc is first thrown from the tee in the direction of the post and sometimes around predetermined obstacles. The disc is then picked up by the player at the point at which it lands and is again thrown in the direction of the post. The process is continued until the disc strikes the post supported disc stopping members. Scoring is by tabulating the number of throws required to place the thrown disc into the basket supported on the post.

In prior flying disc golf games, a problem has arisen with difficulty of seeing the post and basket in low light, such as on heavily overcast days, in the evenings or just before dark, so that the game is stopped anytime the light gets too low for playing. It is accordingly an aim of the present invention to provide a flying disc golf game which can be played in low light levels as well as in the evening. It is also an object to provide a hole for a flying disc golf game which can be easily injection molded and readily assembled at a price suitable for an individual to place at least one or more of the capturing post in his yard for practicing after work and at a price easily affordable by an individual.

Typical prior art U.S. patents which relate to a flying disc golf game can be seen in the U.S. Pat. No. to Headrick et al., No. 4,039,189, for an entrapment device which is provided for use in playing a flying disc golf game and which provides a structure for absorbing the kinetic energy of flying discs thrown at the device to arrest the forward motion of the disc and to cause the disc to be caught by the device. The apparatus in this patent includes a post mounted in the ground having a basket mounted on the post and energy absorbing chains hanging from an upper support so that the chains capture the flying disc and allow it to fall into the basket. A second Headrick U.S. Pat. No. 4,461,484, is also for a flying disc entrapment device and operates in a similar manner but has variations in the chains.

The present invention is an improvement on these prior art patents and other prior art devices for flying disc golf games wherein the post and disc capturing system is adapted to be made from injection molded components and allows the easy spotting of the post in low light or even in the dark by a lamp placed beneath a translucent cover and which shines downward to light the capturing chains and basket. A player can not only see where to throw the disc but can also tell when he has made a hole by the disc hitting the chains and falling into the basket.

SUMMARY OF THE INVENTION

A disc catching apparatus for use in playing a flying disc game includes a vertically extending post supported in the earth or on a portable stanchion and having a basket attached thereto around the post between its ends. A top housing is attached to the top of the post and spaced from the basket and a plurality of elongated flexible disc stopping members, such as flexible chains, are attached to the top housing and hang downwardly into the basket for stopping the flying objects impinging thereupon so that the flying objects will fall into the basket. The top housing has an interior compartment therein having at least one lamp for lighting the basket and hanging chain as well as lighting a translucent lens so that a flying disc game can be played in low light. An improved attachment is provided for attaching chains to the top housing and an improved basket mounting coupler is provided for supporting the basket which coupler can be readily injection molded.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
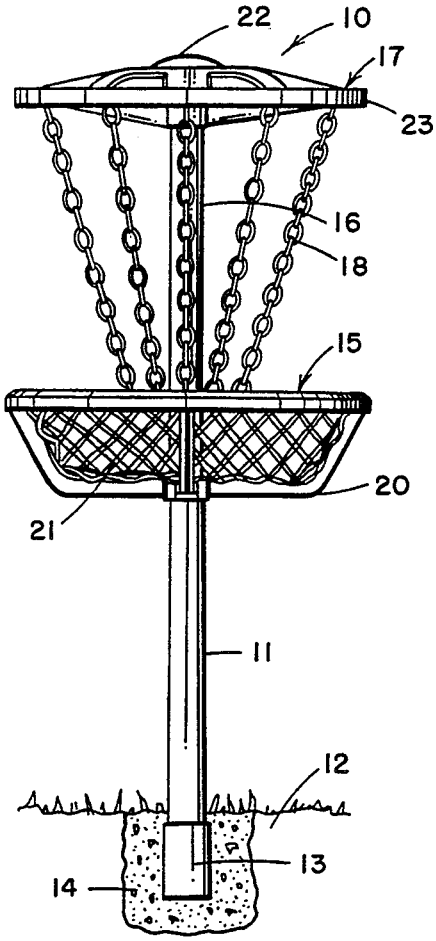
FIG. 1 is a side elevation and partial sectional view of a flying disc game post in accordance with the present invention.
Figure 9:
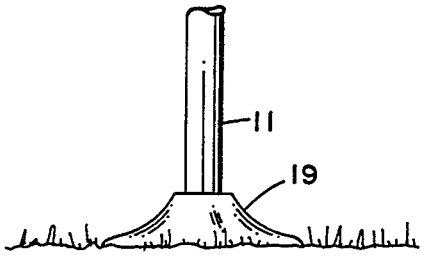
FIG. 9 is a side elevation of an alternate embodiment of the stand portion of the disc game post of FIG. 1.
Figure 2:
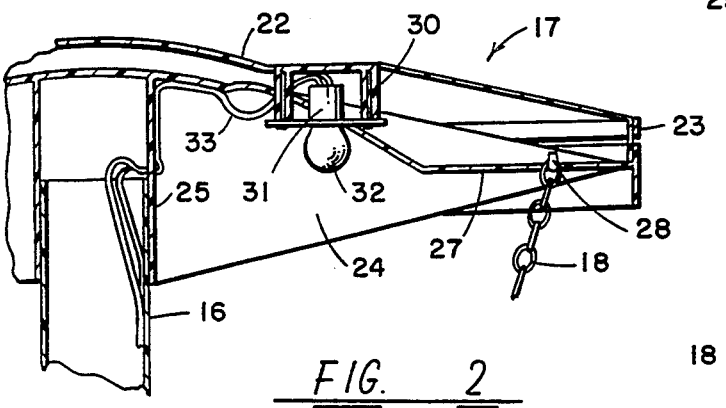
FIG. 2 is a sectional view taken through a portion of the top housing of the embodiment of FIG. 1.

Referring to the drawings and especially to FIGS. 1 and 2, a disc catching apparatus 10 for use in playing a flying disc game, such as a flying disc golf game, is shown having a vertically extending post 11 either placed in the earth 12 within a support sleeve 13 mounted in concrete 14 or on a portable stanchion 19 in FIG. 9. The post 11 has a disc capturing basket 15 attached thereto and a second portion of the post 16 extending vertically from the basket 15. A top housing 17 supports a plurality of chains 18 hanging from the periphery thereof into the basket 15 and are used for capturing a flying disc which impinges upon the chains 18 and falls into the basket 15. The basket 15 is a molded polymer frame 20 having a mesh 21 attached thereto to form a basket for catching discs and to thereby act as the hole for a flying disc golf game. The vertical post 11 may be a polymer or PVC post and the top housing 17 has a translucent lens 22 mounted in the top thereof. The top housing 17 periphery frame 23 is supported by a plurality of brace members 24 extending from a sleeve 25 which is mounted on top of the post 16, as shown in FIG. 2. The brace members 24 support the periphery frame portion 23 as well as the top of the housing 24 having a lens 22 attached thereto and which also has a chain supporting surface 27 with a chain supporting clip 28 having the chain 18 attached thereto at one end thereof.

In addition, the housing 17 has at least one lamp support frame 30 attached thereto having a lamp socket 31 with a lamp 32 removably attached therein. An electrical conductor 33 extends from the lamp socket 31 through an opening in the sleeve 25 and down the hollow post 16 to a power source remotely located from the post. However, a power source could also be a portable source, such as a battery. Thus, the lamp 32, when lit, shines directly below the housing 17 onto the chains 18 and basket 15 and also illuminates the post 16 so that these items can be seen in low light so that a person playing a disc game is able to identify and to throw his disc in low light. In addition, the translucent lens 22 is illuminated by the lamp 32 so that the housing 17 can be more readily identified by the glowing translucent surface.

The housing 17 is designed to that it can be made of a molded polymer, such as a polycarbonate or other polymer, and yet maintains sufficient strength to withstand the beating taken from flying discs and by virtue of the braces 24 extending between attaching sleeve 25 and the outer framework 23. Similarly, the basket 15 is designed to be made of a molded polymer and the vertical post sections 11 and 16 may also be made of a standard PVC pipe.

Figure 3:
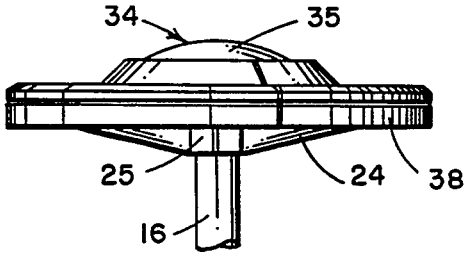
FIG. 3 is a side elevation of a second embodiment of the top housing.

FIG. 3 shows an alternate embodiment of a top housing 34 attached to the post member 16 and formed of a molded portion having a different shaped translucent lens 35.

Figure 4:
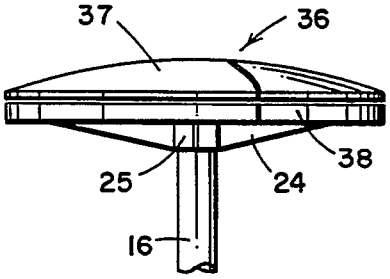
FIG. 4 is a side elevation of yet another embodiment of the top housing.

FIG. 4 shows yet another embodiment of a top housing 36 mounted to the pole section 16 and having a translucent lens 37 covering most of the top of the housing 36 over the frame edge 38 so that the housing 36 can be readily identified from a distance when the lamp 32 is lit and the translucent housing is glowing from the light.

Figure 5:
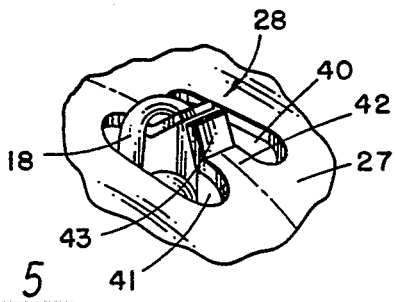
FIG. 5 is a perspective view of the molded chain supporting clip of the top housing.

FIG. 5 shows a perspective view of a chain clip 28 mounted in the chain support surface 27 which has been molded with a pair of slots 40 and 41 having a pair of arms 42 therebetween, each with an upright tab portion 43, so that the end of a chain 18 link can slide over the tab portion 43 and rest on the arm 42. To attach the chain 18 merely requires sliding a link between the pair of vertical tab portions 43 which expands them to allow the chain link portion to slide therethrough and then rest on one of the arms 42. When the arm 42 is pulled on by the chain 18 upon a disc hitting the chain, it will merely pull the arm 42 down and the tab portions 43 together so that the chain 18 cannot slip off.

Figure 6:
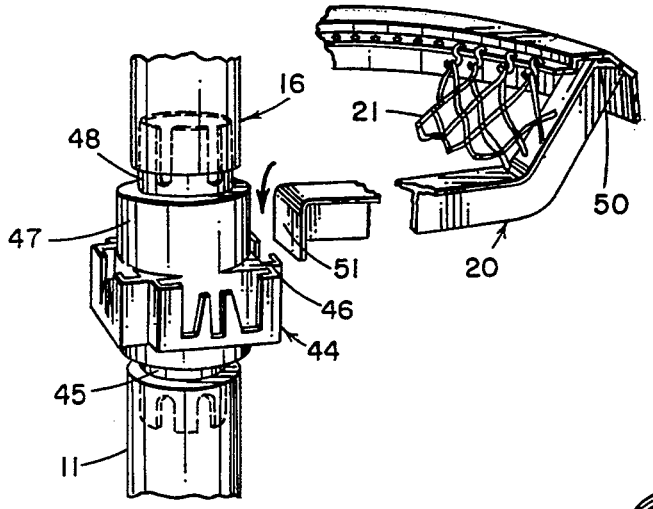
FIG. 6 is an exploded perspective view of a basket coupler and basket arm for attaching a basket and mesh net to a vertical post.

Turning to FIG. 6, the post 11 can be seen having an injection molded coupler 44 attached thereto with a sleeve portion 45 and having a basket clip portion 46 on four sides thereof along with a vertical cylindrical portion 47 and then a cylindrical portion 48 for attaching the coupler 44 to the post section 16. Cylindrical post attaching portions 45 and 48 each have a plurality of slots cut therein to allow a slight give so that a press fit of these sleeves into the post will hold the post 11 and 16 together with the coupler 44 therebetween. The basket frame 20 can be seen having four frame arms 50, each having a male coupling member 51 on the end thereof for sliding into the coupling portions 46 so that the basket can be readily slid onto the coupler 44 to support the frame 20 having the mesh net 21 attached thereto which net 21 can be a nylon net of assorted colors to make the basket look more visible and attractive. Coupler 44 can be an injection molded coupler which can be readily inserted into PVC pipe members 11 and 16 for readily attaching a basket.

Figure 7:
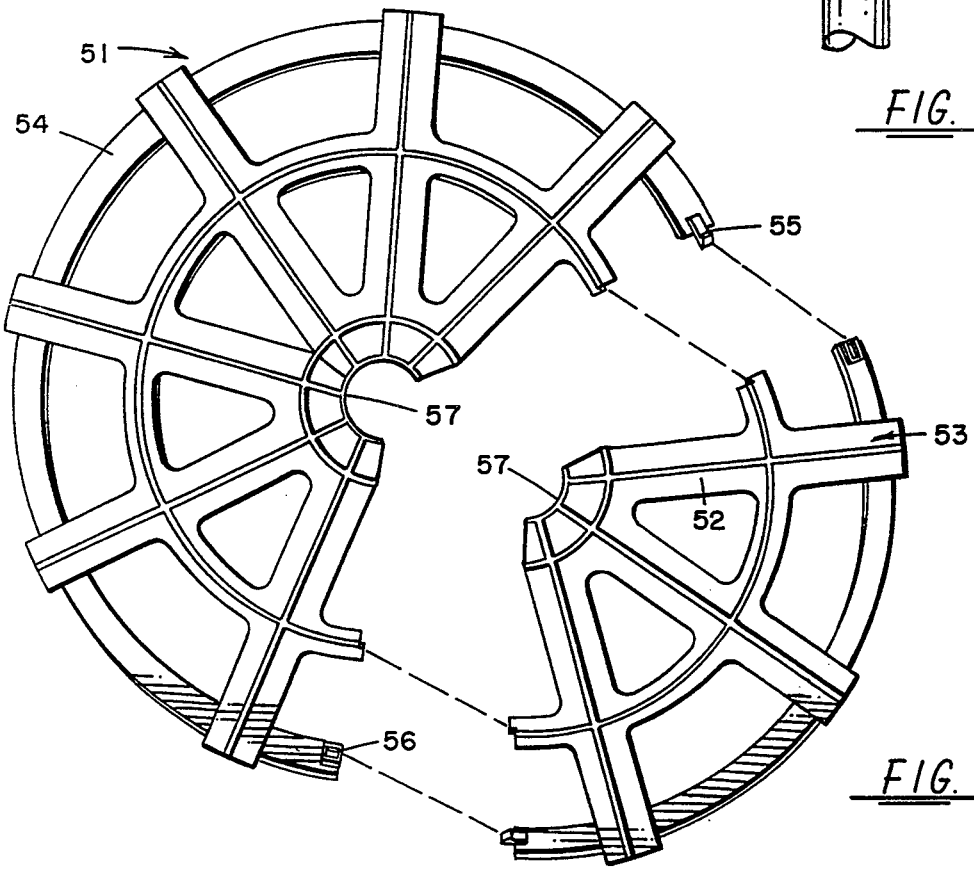
FIG. 7 is a bottom plan view of an alternate segmented basket.

Another embodiment of a basket frame can be formed by injection molding, as shown in FIG. 7, in which the basket 51 has a frame 52 and is formed with a smaller segment 53 and a larger segment 54 which are connected with a pair of snaps on each segment 53 and 54 frame portion 51 including a male snap 55 and a female snap 56 interconnecting with snap portions on each section. Thus, the basket frame 53 can be assembled by the two parts being snapped together which forms a sleeve 57 in the center so that the pipe sections 11 and 16 can be inserted onto either side of the basket frame 53. The basket frame in this case has a plurality of frame members 52 formed without the use of a mesh.

Figure 8:
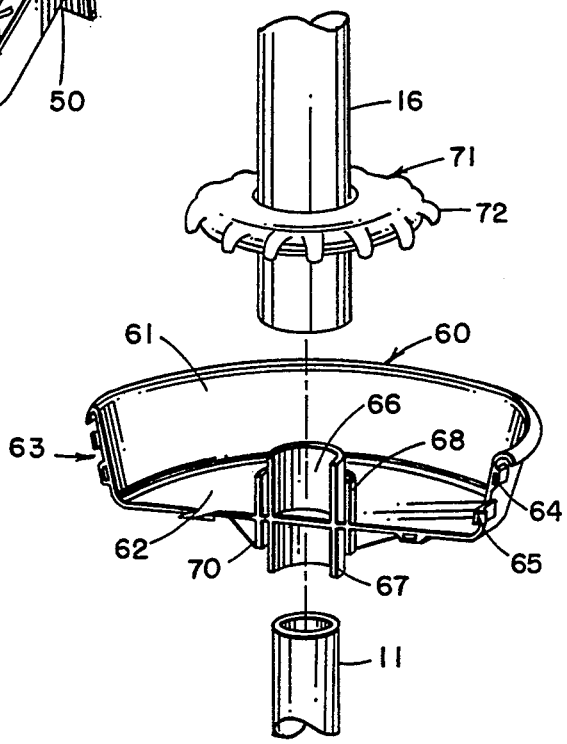
FIG. 8 is an exploded perspective view of an alternate embodiment of a basket and basket supporting coupler.

Turning to FIG. 8, another embodiment of a basket 60 is illustrated in which the basket is a solid portion 61 with a solid bottom 62 and having a plurality of snap clip fasteners 63 for snapping two halves together including a female snap 64 and a male snap 65. When the two halves of the basket 60 are snapped together they form a top sleeve 66 in the middle and a bottom sleeve 67 from the bottom. In addition, a small sleeve 68 extends around the sleeve 66 to form a channel for sliding and holding the end of the post 16. A similar sleeve 70 extends around the sleeve 67 to form a channel to receive the end of PVC post member 11, as shown attached to the post 16 and has a plurality of chain tabs 72 for catching one link of the chains 18 hanging from the top housing. The basket in embodiments of FIG. 7 and 8 advantageously can be injection molded from polyethylene or similar polymer and are molded complete with the attachment coupler for readily attaching the baskets to the post and which simultaneously break down for packaging and shipment and do not require the use of a mesh net.

It should be clear at this point that a flying disc capturing post has been provided which can be made entirely from commercially available components and injection molded plastic parts which can be rapidly assembled to reduce the price of a flying disc post game. In addition, the post is designed for use in playing in low light or at night time and, which from a single light source, provides a glowing translucent top as well as lighted chains, post and basket. However, the present invention should not be construed as limited to the forms shown which are to be considered illustrative rather than restrictive.

I claim:

1. A disc catching apparatus for use in playing a flying disc game comprising:

a vertical extending post;

a basket attached around said post for catching falling discs, said basket having a frame formed in a plurality of segments and having attaching fasteners for locking said basket segments together around said post;

a top housing attached to said post above said basket and spaced therefrom; and a plurality of elongated flexible disc stopping members attached to said top housing and hanging downwardly into said basket for stopping flying objects impinging thereupon whereby the flying objects will fall into said basket.

2. A disc catching apparatus for use in playing a flying disc game in accordance with claim 1 in which said top housing has an interior compartment therein and having at least one lamp mounted therein for lighting said basket and flexible members whereby said flying disc game can be played in low light.

3. A disc catching apparatus for use in playing a flying disc game in accordance with claim 2 in which said top housing has a translucent dome for producing lighted housing to identify said top housing and vertical post.

4. A disc catching apparatus for use in playing a flying disc game in accordance with claim 3 in which said basket has a polymer frame and a polymer mesh attached to said frame.

5. A disc catching apparatus for use in playing a flying disc game in accordance with claim 4 in which said polymer mesh is a nylon mesh.

6. A disc catching apparatus for use in playing a flying disc game in accordance with claim 5 including an injection molded polymer coupler shaped to attach into an end opening in a section of said post and to have a second post section attached thereto and extending therefrom, said coupling being shaped to couple to said basket for supporting said basket to said post.

7. A disc catching apparatus for use in playing a flying disc game in accordance with claim 6 in which said top housing has a translucent cover covering a portion thereof and illuminated by said lamp.

8. A disc catching apparatus for use in playing a flying disc game in accordance with claim 7 including a flexible conductor extending between a lamp socket in said top housing and a source of power.

9. A disc catching apparatus for use in playing a flying disc game in accordance with claim 8 in which each said elongated flexible disc stopping member is a piece of a chain.

10. A disc catching apparatus for use in playing a flying disc game in accordance with claim 9 in which said top housing has removable top for access to said lamp 11. A disc catching apparatus for use in playing a flying disc game in accordance with claim 10 in which said top housing attaches to top of said vertical extending post.

12. A disc catching apparatus for use in playing a flying disc game in accordance with claim 11 in which said top housing has a plurality of brace members connected by a sleeve attached to said post and a periphery frame portion.

13. A disc catching apparatus for use in playing a flying disc game in accordance with claim 12 including low voltage wiring and a low voltage transformer to convert a power source voltage to low voltage.

14. A disc catching apparatus for use in playing a flying disc game in accordance with claim 13 in which said top housing translucent top has open bottom to allow light from said lamp to shine on said flexible members and basket.

* * * * *